US010202561B2

(12) United States Patent
Sanson et al.

(10) Patent No.: US 10,202,561 B2
(45) **Date of Patent: *Feb. 12, 2019**

(54) LUBRICATING COMPOSITIONS FOR MOTOR VEHICLES

(71) Applicants: TOTAL MARKETING SERVICES, Puteaux (FR); DOW GLOBAL TECHNOLOGIES LLC, Midland, MI (US)

(72) Inventors: Julien Sanson, Lyons (FR); Alder Da Costa D'Ambros, Lyons (FR); Nadjet Khelidj, Zurich (CH)

(73) Assignees: TOTAL MARKETING SERVICES, Puteaux (FR); DOW GLOBAL TECHNOLOGIES LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/500,265

(22) PCT Filed: Jul. 30, 2015

(86) PCT No.: PCT/EP2015/067492

§ 371 (c)(1),
(2) Date: Jan. 30, 2017

(87) PCT Pub. No.: WO2016/016362

PCT Pub. Date: Feb. 4, 2016

(65) Prior Publication Data

US 2017/0226442 A1 Aug. 10, 2017

(30) Foreign Application Priority Data

Jul. 31, 2014 (FR) ..... 14 57438

(51) Int. Cl.
*C10M 107/34* (2006.01)
*C10M 101/02* (2006.01)

(52) U.S. Cl.
CPC ..... *C10M 107/34* (2013.01); *C10M 101/02* (2013.01); *C10M 2203/1006* (2013.01); *C10M 2207/0406* (2013.01); *C10M 2209/107* (2013.01); *C10M 2209/1033* (2013.01); *C10M 2209/1075* (2013.01); *C10N 2220/022* (2013.01); *C10N 2230/02* (2013.01); *C10N 2240/04* (2013.01); *C10N 2240/10* (2013.01)

(58) Field of Classification Search
CPC ..... C10M 107/34; C10M 2209/1033; C10M 2209/107; C10M 2209/1075
See application file for complete search history.

(56) References Cited

U.S. PATENT DOCUMENTS

| | | | | |
|---|---|---|---|---|
| 7,456,138 | B2 * | 11/2008 | Sherman | C08G 65/2609 508/513 |
| 8,969,271 | B2 * | 3/2015 | Greaves | C10M 107/34 508/579 |
| 9,546,335 | B2 * | 1/2017 | Obrecht | C10M 169/04 |
| 2014/0018273 | A1 | 1/2014 | Zweifel et al. | |
| 2014/0303053 | A1 * | 10/2014 | Greaves | C10M 169/04 508/282 |
| 2015/0119303 | A1 | 4/2015 | Guerin et al. | |
| 2015/0275124 | A1 * | 10/2015 | Greaves | C10M 169/041 508/579 |
| 2017/0211009 | A1 * | 7/2017 | Khelidj | C10M 145/32 |
| 2017/0211010 | A1 * | 7/2017 | Khelidj | C10M 145/34 |

FOREIGN PATENT DOCUMENTS

WO 2013/164449 A1 11/2013

OTHER PUBLICATIONS

International Search Report, dated Oct. 8, 2015, from corresponding PCT Application.

* cited by examiner

*Primary Examiner* — Ellen M McAvoy
(74) *Attorney, Agent, or Firm* — Young & Thompson

(57) ABSTRACT

Disclosed are lubricating compositions and base oils for motor vehicles, specifically for engines, gearboxes, or vehicle axle assemblies. The lubricating composition contains an oil-soluble polymer that is a specific polyalkyl glycol or a specific polyalkylene glycol (PAG). Also described is use of the lubricating composition for reducing fuel consumption in a vehicle provided with an engine, an axle assembly, or a gearbox that are lubricated using the lubricating composition or the specific PAG.

15 Claims, No Drawings

LUBRICATING COMPOSITIONS FOR MOTOR VEHICLES

The present invention relates to the field of lubricating compositions and of base oils for motor vehicles. The invention provides a lubricating composition for an engine, a gear box or a vehicle bridge. This lubricating composition comprises a polymer soluble in oil which is a particular polyalkyl glycol or a particular polyalkylene-glycol (PAG).

The invention also relates to the use of this lubricating composition for reducing the consumption of fuel of a vehicle equipped with an engine, of a bridge or of a gear box lubricated by means of this lubricating composition or of this particular PAG.

The developments of engines and of performances of the lubricating compositions for an engine are inexplicably linked. The more the engines have a complex design, the more the yield and the optimization of consumption are higher and the more the lubricating composition for an engine is in demand and should improve its performances.

Very high compression in the engine, greater piston temperatures, in particular in the area of the upper piston segment, modern valve controls and without any maintenance with hydraulic pushers, as well as very high temperatures in the engine space increasingly request lubricants for modern engines.

The conditions of use of gasoline engines and of diesel engines include both extremely short covered routes and long paths. Indeed, 80% of the paths of cars in Western Europe are less than 12 kilometers while vehicles cover yearly distances ranging up to 300,000 km.

The oil-change intervals are also very variable, from 5,000 km for certain small diesel engines, they may range up to 100,000 km on the diesel engines of modern utility vehicles.

The lubricating compositions for motor vehicles therefore have to have improved properties and performances.

Lubricating compositions for engines therefore should meet many goals which are sometimes contradictory. These goals ensue from five main functions of the lubricating compositions for engines which are lubrication, cooling, no leaking, anticorrosion protection and pressure transmission.

The lubrication of the parts sliding on each other plays a determining role, in particular for reducing friction and wear, notably allowing fuel savings.

Another essential requirement of lubricating compositions for engines relates to the aspects related to the environment. Indeed it has become essential to reduce the oil consumption as well as the fuel consumption, in particular with the purpose of reducing $CO_2$ emissions. It is also important to reduce emissions of burnt gases, for example by formulating oils so that the catalyst remains perfectly functional during the whole of its lifetime. It is also important to limit or avoid the use of toxic additives in order to reduce or limit their removal, for example by reprocessing or by combustion.

The nature of the lubricating compositions for engines for automobiles has an influence on the emission of pollutants and on the fuel consumption. Lubricating compositions for engines for automobiles allow energy savings which are sometimes referred to as "fuel-eco" (FE). Such «fuel-eco» oils were developed for meeting these new needs.

Reduction of energy losses is therefore a constant research in the field of lubricants for automobiles.

As for them, the oils for gear boxes or for bridges, and more generally oils for gears, should meet many requirements, notably related to the driving comfort (perfect gear change, silent operation, operation without any incidents, great reliability), to the lifetime of the assembly (reduction of wear during driving under cold conditions, no deposits and great thermal stability, greasing safety at high temperatures, stable viscosity situation and absence of shear losses, long lifetime) as well as to taking into account environmental aspects (lower fuel consumption, reduction in oil consumption, low noise generation, easy discharge).

These are requirements imposed to oils for gear boxes under manual control and axle gears.

As regards the requirements imposed to the oils of automatic gear boxes (ATF (for automatic transmission fluids) oils), because of their use, very specific requirements appear for ATF oils which are a great constancy of the friction coefficient during the whole dwelling time for optimal gear change, excellent stability to ageing for long oil change intervals, good viscosity-temperature strength in order to guarantee perfect operation with a hot engine and a cold engine and sufficient seal compatibility with different elastomers used in the transmission gaskets so that the latter do not swell, do not shrink and do not become brittle.

Moreover, in the automotive field, seeking reduction in the $CO_2$ emissions forces the development of products giving the possibility of reducing friction in gear boxes and in bridge differentials. This friction reduction in gear boxes and in bridge differentials has to be obtained for different operating conditions. The friction reductions should relate to the internal frictions of the lubricant but also the frictions of elements making up the gear boxes or the bridge differentials, in particular metal elements.

As vehicle transmission oils, it is possible to use refined petroleum products, hydrocracking oils or synthetic liquids, whether these are polyalphaolef ins or esters. In certain cases, polyglycols are also used which generally have the drawback of not being or not very miscible with the other base liquids.

In order to obtain sufficient performances, vehicle transmission oils have also to be completed with additives depending on the quality requirements, in particular of the additives for high pressure.

As regards the uses for lubrication of a vehicle engine, additives are also used.

As additives modifying the friction coefficient, organometal compounds, for example comprising molybdenum and notably molybdenum sulfide, are currently used. Mention may be made of molybdenum dithiocarbamates (MoDTC) as a majority source of molybdenum. Moreover, different (co)polymers improving the viscosity index in a lubricating composition are also known.

WO 2013-164449 discloses an oil of the PAG type stemming from the copolymerization butylene oxide and propylene oxide. This oil has a viscosity index of the order of 100 or 120.

US 2014-018273 discloses methylated PAG oils for which the molar mass is high or which comprise alkyl-ether groups.

It is necessary to provide alternative base oils, in particular oils having a high viscosity index (VI) as well as a low traction coefficient.

The sought lubricating compositions should have a high viscosity index in order to avoid energy losses under cold conditions because of the friction but also for maintaining under hot conditions a sufficient film of lubricant on the lubricated elements.

A high viscosity index therefore guarantees a lesser drop in the viscosity when the temperature increases.

In a known way, as lubricant compositions for vehicle engines, synthetic liquids are used such as polyalphaolefin (PAO) oils, esters and polyglycols; non-conventional mineral oils such as hydrocracked products; conventional mineral oils; as well as different mixtures thereof.

Thus, in the field of bases with a high VI and with a low traction coefficient, like lubricating compositions for vehicle engines, mixtures of PAO oils and esters are conventionally used, for example with a mass proportion of esters of about 10%; mixtures of PAO oils and of hydrocracked and hydro-isomerized oils (group III or Gp III) or mixtures of PAO oils and of hydrocracked and hydro-isomerized oils with additives or further base oils GTL (gas-to-liquid or oils obtained from natural liquefied gas, for example by Fisher-Tropsch methods).

Moreover, it is frequent to encounter solubility problems during the use of PAG of the state of the art. The use of PAGs of the state of the art is therefore generally limited to certain applications such as industrial oils and not as oils for engines or for vehicle transmissions.

Therefore there exists a need for providing oils and lubricating compositions for engines or for vehicle transmissions which give the possibility of providing a solution to all or part of the problems of the oils or lubricating compositions of the state of the art.

Thus, the invention provides a lubricating composition comprising at least one oil of formula (I)

(I)

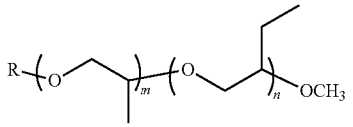

wherein

R represents a linear or branched $C_1$-$C_{30}$ alkyl group;

m and n represent independently an average number ranging from 1 to 5.

Preferably, the lubricating composition according to the invention comprises at least one oil of formula (I) wherein R represents a group selected from among a linear $C_8$ alkyl group; a branched $C_8$ alkyl group; a linear $C_9$ alkyl group; a branched $C_9$ alkyl group; a linear $C_{10}$ alkyl group; a branched $C_{10}$ alkyl group; a linear $C_{11}$ alkyl group; a branched $C_{11}$ alkyl group; a linear $C_{12}$ alkyl group; a branched $C_{12}$ alkyl group; a linear $C_{13}$ alkyl group; a branched $C_{13}$ alkyl group; a linear $C_{14}$ alkyl group; a branched $C_{14}$ alkyl group; a linear $C_{15}$ alkyl group; a branched $C_{15}$ alkyl group.

More preferably, the lubricating composition according to the invention comprises at least one oil of formula (I) wherein R represents a branched $C_8$ alkyl group or a linear $C_{12}$ alkyl group.

Even more preferably, the lubricating composition according to the invention comprises at least one oil of formula (I) wherein R represents a linear $C_{12}$ alkyl group.

Also preferably, the lubricating composition according to the invention comprises at least one oil of formula (I) wherein m is greater than or equal to n; or m represents an average number ranging from 2 to 4.5; or n represents an average number ranging from 1.5 to 4.

As examples of preferred lubricating compositions according to the invention, mention may be made of a lubricating composition comprising at least one oil of formula (I) wherein m represents an average number ranging from 2.5 to 3.5; or n represents an average number ranging from 2 to 3.

As examples of more preferred lubricating compositions according to the invention, mention may be made of a lubricating composition comprising at least one oil of formula (I) wherein m represents an average number equal to 2.5 and n represents an average number equal to 2; or m represents an average number equal to 3.5 and n represents an average number equal to 2.8.

As other examples of preferred lubricating compositions according to the invention, mention may be made of a lubricating composition comprising at least one oil of formula (I) wherein R represents a branched $C_8$ alkyl group, m represents an average number ranging from 2 to 4.5, and n represents an average number ranging from 1.5 to 4; or R represents a branched $C_8$ alkyl group, m represents an average number ranging from 2.5 to 3.5 and n represents an average number ranging from 2 to 3.

As other examples of more preferred lubricating compositions according to the invention, mention may be made of a lubricating composition comprising at least one oil of formula (I) wherein R represents a linear $C_{12}$ alkyl group, m represents an average number ranging from 2 to 4.5, and n represents an average number ranging from 1.5 to 4; or R represents a linear $C_{12}$ alkyl group, m represents an average number ranging from 2.5 to 3.5 and n represents an average number ranging from 2 to 3.

As examples of also preferred lubricating compositions according to the invention, mention may be made of a lubricating composition comprising at least one oil of formula (I) wherein R represents a branched $C_8$ alkyl group, m represents an average number equal to 2.5 and n represents an average number equal to 2; or R represents a branched $C_8$ alkyl group, m represents an average number equal to 3.5 and n represents an average number equal to 2.8.

As examples of most preferred lubricating compositions according to the invention, mention may be made of a lubricating composition comprising at least one oil of formula (I) wherein R represents a linear $C_{12}$ alkyl group, m represents an average number equal to 2.5 and n represents an average number equal to 2; or R represents a linear $C_{12}$ alkyl group, m represents an average number equal to 3.5 and n represents an average number equal to 2.8.

Preferably, the lubricating composition according to the invention comprises at least one oil of formula (I) for which (a) the kinematic viscosity of 100° C., measured according to the ASTM D445 standard, ranges from 2.5 to 4.5 $mm^2 \cdot s^{-1}$; or for which (b) the viscosity index is greater than 160 or is comprised between 160 and 210; or for which (c) the pour point is less than −40° C.; or for which (d) the dynamic viscosity (CCS) at −35° C., measured according to the ASTM D5293 standard is less than 1,200 mPa·s.

Generally according to the invention, the viscosity index is calculated according to the ASTM D2270 standard and the pour point is measured according to the EN ISO 3016 standard.

More preferably, the lubricating composition according to the invention comprises at least one oil of formula (I) for which (a) the kinematic viscosity at 100° C., measured according to the ASTM D445 standard, ranges from 2.5 to 4.5 $mm^2 \cdot s^{-1}$;

(b) the viscosity index is greater than 160 or is comprised between 160 and 210;

(c) the pour point is less than −40° C.;

(d) the dynamic viscosity (CCS) at −35° C., measured according to the ASTM D5293 standard is less than 1,200 mPa·s.

More preferably, the lubricating composition according to the invention comprises at least one oil of formula (I) wherein m represents an average number equal to 2.5 and n represents an average number equal to 2 and for which (a) the kinematic viscosity at 100° C., measured according to the ASTM D445 standard, ranges from 2.5 to 3.5 $mm^2 \cdot s^{-1}$; or for which (b) the viscosity index is comprised between 160 and 180; or for which (c) the pour point is less than −40° C.; or for which (d) the dynamic viscosity (CCS) at −35° C., measured according to the ASTM D5293 standard is less than 500 mPa·s.

Also more preferably, the lubricating composition according to the invention comprises at least one oil of formula (I) wherein m represents an average number equal to 2.5 and n represents an average number equal to 2 and for which (a) the kinematic viscosity at 100° C., measured according to the ASTM D445 standard, ranges from 2.5 to 3.5 $mm^2 \cdot s^{-1}$;

(b) the viscosity index is comprised between 160 and 180;

(c) the pour point is less than −40° C.;

(d) the dynamic viscosity (CCS) at −35° C., measured according to the ASTM D5293 standard is less than 500 mPa·s.

Also more preferably, the lubricating composition according to the invention comprises at least one oil of formula (I) wherein m represents an average number equal to 3.5 and n represents an average number equal to 2.8 and for which (a) the kinematic viscosity a 100° C., measured according to the ASTM D445 standard, ranges from 3.5 to 4.5 $mm^2 \cdot s^{-1}$; or for which (b) the viscosity index is comprised between 180 and 210; or for which (c) the pour point is less than −50° C.; or for which (d) the dynamic viscosity (CCS) at −35° C., measured according to the ASTM D5293 standard is less than 1,200 mPa·s.

Also more preferably, the lubricating composition according to the invention comprises at least one oil of formula (I) wherein m represents an average number equal to 3.5 and n represents an average number equal to 2.8 and for which (a) the kinematic viscosity at 100° C., measured according to the ASTM D445 standard, ranges from 3.5 to 4.5 $mm^2 \cdot s^{-1}$;

(b) the viscosity index is comprised between 180 and 210;

(c) the pour point is less than −50° C.;

(d) the dynamic viscosity (CCS) at −35° C., measured according to the ASTM D5293 standard is less than 1,200 mPa·s.

Advantageously, the lubricating composition according to the invention comprises from 2 to 60% by weight of at least one oil of formula (I); or from 2 to 50% by weight of at least one oil of formula (I); or from 5 to 40% by weight of at least one oil of formula (I); or from 5 to 30% by weight of at least one oil of formula (I).

A preferred example of a lubricating composition according to the invention comprises from 5 to 40% by weight, preferably from 10 to 35% by weight or from 15 to 25% by weight, of at least one oil of formula (I) wherein m represents an average number equal to 2.5 and n represents an average number equal to 2 and for which the kinematic viscosity at 100° C., measured according to the ASTM D445 standard, ranges from 2.5 to 3.5 $mm^2 \cdot s^{-1}$;

the viscosity index is comprised between 160 and 180;

the pour point is less than −40° C.;

the dynamic viscosity (CCS) at −35° C., measured according to the ASTM D5293 standard is less than 500 mPa·s.

Another preferred example of a lubricating composition according to the invention comprises from 5 to 35% by weight, preferably from 8 to 30% by weight or 10% by weight, 20% by weight or 30% by weight, of at least one oil of formula (I) wherein m represents an average number equal to 3.5 and n represents an average number equal to 2.8 and for which (a) the kinematic viscosity at 100° C., measured according to the ASTM D445 standard, ranges from 3.5 to 4.5 $mm^2 \cdot s^{-1}$;

(b) the viscosity index is comprised between 180 and 210;

(c) the pour point is less than −50° C.;

(d) the dynamic viscosity (CCS) at −35° C., measured according to the ASTM D5293 standard is less than 1,200 mPa·s.

Advantageously, the lubricating composition according to the invention also comprises at least one other base oil selected from oils of the group III, the oils of group IV and the oils of group V; or at least one additive; or at least one other base oil selected from among oils of group III, oils of group IV and oils of group V and at least one additive.

Generally, the lubricating composition according to the invention may comprise any type of mineral, synthetic or natural, animal or vegetable lubricating base oil adapted to their use.

The base oils used in the lubricating compositions according to the invention may be oils of mineral or synthetic origins belonging to the groups I to V according to the classes defined in the API classification (or their equivalents according to the ATIEL classification) (table A) or mixtures thereof.

TABLE A

| | Content of saturated substances | Sulfur content | Viscosity index (VI) |
|---|---|---|---|
| Group I Mineral oils | <90% | >0.03% | 80 ≤ VI < 120 |
| Group II Hydrocracked oils | ≥90% | ≤0.03% | 80 ≤ VI < 120 |
| Group III Hydrocracked or hydro-isomerized oils | ≥90% | ≤0.03% | ≥120 |
| Group IV | Polyalphaolefins (PAO) | | |
| Group V | Esters and other bases not included in the groups I to IV | | |

The mineral base oils according to the invention include all types of bases obtained by atmospheric distillation and vacuum distillation of crude petroleum, followed by refining operations such as extraction with a solvent, deasphalting, dewaxing with a solvent, hydrotreatment, hydrocracking, hydroisomerization and hydrofinishing.

Mixtures of synthetic and mineral oils may also be used.

Generally no limitation exists as to the use of different lubricating bases for producing the lubricating compositions according to the invention, except that they have to have properties, notably of viscosity, viscosity index, sulfur content, oxidation strength, adapted to useful engines or for vehicle transmissions.

The base oils of the lubricating compositions according to the invention may also be selected from among synthetic oils, such as certain esters of carboxylic acids and of alcohols, and from among polyalphaolefins. The polyalphaolefins used as base oils are for example obtained from monomers comprising from 4 to 32 carbon atoms, for example from octene or decene, and for which the viscosity at 100° C. is comprised between 1.5 and 15 $mm^2 \cdot s^{-1}$ according to the ASTM D445 standard. Their average molecular mass is generally comprised between 250 and 3,000 according to the ASTM D5296 standard.

Advantageously, the lubricating composition according to the invention comprises at least 50% by mass of base oils based on the total mass of the composition.

More advantageously, the lubricating composition according to the invention comprises at least 60% by mass, or even at least 70% by mass, of base oils based on the total mass of the composition.

In a more particularly advantageous way, the lubricating composition according to the invention comprises from 75 to 99.9% by mass of base oils based on the total mass of the composition.

The invention also provides a lubricating composition for motor vehicles comprising at least one lubricating composition according to the invention, at least one base oil and at least one additive.

Many additives may be used for this lubricating composition according to the invention.

The preferred additives for the lubricating composition according to the invention are selected from among detergent additives, anti-wear additives, friction modifier additives, extreme pressure additives, dispersants, agents improving the pour point, anti-foam agents, thickeners and mixtures thereof.

Preferably, the lubricating composition according to the invention comprises at least one anti-wear additive, at least one extreme pressure additive or mixtures thereof.

The anti-wear additives and the extreme pressure additives protect the frictional surfaces by forming a protective film adsorbed on these surfaces.

There exist a large variety of anti-wear additives. Preferably for the lubricating composition according to the invention, the anti-wear additives are selected from among phosphorus-sulfur additives like metal alkylthiophosphates, in particular zinc alkylthiophosphates, and more specifically zinc dialkyldithiophosphates or ZnDTP. The preferred compounds are of the formula $Zn((SP(S)(OR^1)(OR^2))_2$, wherein $R^1$ and $R^2$, either identical or different, represent independently an alkyl group, preferentially an alkyl group including 1 to 18 carbon atoms.

Amine phosphates are also anti-wear additives which may be used in the lubricating composition according to the invention. However, the phosphorus brought by these additives may act as a poison for the catalytic systems of automobiles since these additives generate ashes. It is possible to minimize these effects by partly substituting the amine phosphates with additives not providing phosphorus, such as for example polysulfides, notably sulfur-containing olefins.

Advantageously, the lubricating composition according to the invention may comprise from 0.01 to 6% by mass, preferentially from 0.05 to 4% by mass, more preferentially from 0.1 to 2% by mass based on the total mass of lubricating composition, of anti-wear additives and extreme-pressure additives.

Advantageously, the lubricating composition according to the invention may comprise at least one friction modifier additive. The friction modifier additive may be selected from among a compound providing metal elements and a compound without any ashes. Among the compounds providing metal elements, mention may be made of the complexes of transition metals, such as Mo, Sb, Sn, Fe, Cu, Zn, the ligands of which may be hydrocarbon compounds comprising oxygen, nitrogen, sulfur or phosphorus atoms. Friction modifier additives without any ashes are generally of organic origin and may be selected from among fatty acid and polyol monoesters, alkoxylated amines, alkoxylated fatty amines, fatty epoxides, borate fatty epoxides; fatty amines or glycerol esters of a fatty acid. According to the invention, the fatty compounds comprise at least one hydrocarbon group comprising from 10 to 24 carbon atoms.

Advantageously, the lubricating composition according to the invention may comprise from 0.01 to 2% by mass or from 0.01 to 5% by mass, preferentially from 0.1 to 1.5% by mass or from 0.1 to 2% by mass based on the total mass of the lubricating composition, of friction modifier additive.

Advantageously, the lubricating composition according to the invention may comprise at least one antioxidant additive.

The antioxidant additive generally gives the possibility of delaying the degradation of the operating lubricating composition. This degradation may notably be expressed by the formation of deposits, by the presence of muds or by an increase in the viscosity of the lubricating composition.

The antioxidant additives notably act as radical inhibitors or hydroperoxide destructors. From among the antioxidant additives currently used, mention may be made of the antioxidant additives of the phenolic type, the antioxidant additives of the amine type, the phosphorus-sulfur-containing antioxidant additives. Some of these antioxidant additives, for example the phosphorus-sulfur-containing antioxidant additives, may be generators of ashes. The phenolic antioxidant additives may be without any ashes or else be in the form of neutral or basic metal salts. The antioxidant additives may notably be selected from among sterically hindered phenols, sterically hindered phenol esters and sterically hindered phenols comprising a thioether bridge, diphenylamines, diphenylamines substituted with at least one $C_1$-$C_{12}$ alkyl group, N,N'-dialkyl-aryl-diamines and mixtures thereof.

Preferably according to the invention, the sterically hindered phenols are selected from among the compounds comprising a phenol group, at least one neighboring carbon to the carbon bearing the alcohol function of which is substituted with at least one $C_1$-$C_{10}$ alkyl group, preferably a $C_1$-$C_6$ alkyl group, preferably a $C_4$ alkyl group, preferably with a ter-butyl group.

The amine compounds are another class of antioxidant additives which may be used, optionally in combination with phenolic antioxidant additives. Examples of amine compounds are aromatic amines, for example aromatic amines of formula $NR^1R^2R^3$ wherein $R^1$ represents an aliphatic group or an aromatic group, optionally substituted, $R^2$ represents an aromatic group, optionally substituted, $R^3$ represents a hydrogen atom, an alkyl group, an aryl group or a group of formula $R^4S(O)_zR^5$ wherein $R^4$ represents an alkylene group or an alkenylene group, $R^5$ represents an alkyl group, an alkenyl group or an aryl group and z represents 0, 1 or 2.

Sulfurized alkyl phenols or their alkaline and earth-alkaline metal salts may also be used as antioxidant additives.

Another class of antioxidant additives is that of copper-containing compounds, for examples copper thio- or dithiophosphates, copper salts and of carboxylic acids, dithiocarbamates, sulphonates, phenates, copper acetylacetonates. The salts of copper I and II, salts of succinic acid or anhydride may also be used.

The lubricating composition according to the invention may contain any types of antioxidant additives known to one skilled in the art.

Advantageously, the lubricating composition comprises at least one antioxidant additive without any ashes.

Also advantageously, the lubricating composition according to the invention comprises from 0.5 to 2% by weight based on the total mass of the composition, of at least one antioxidant additive.

The lubricating composition according to the invention may also comprise at least one detergent additive.

Detergent additives generally give the possibility of reducing the formation of deposits at the surface of the metal parts by dissolution of the secondary oxidation and combustion products.

The detergent additives used in the lubricating composition according to the invention are generally known to one skilled in the art. The detergent additives may be anionic compounds comprising a long lipophilic hydrocarbon chain and a hydrophilic head. The associated cation may be a metal cation of an alkaline or earth-alkaline metal.

Detergent additives are preferentially selected from among alkaline metal salts or salts of earth-alkaline metals with carboxylic acids, sulfonates, salicylates, naphthenates, as well as phenate salts. Alkaline and earth-alkaline metals are preferentially calcium, magnesium, sodium or barium.

These metal salts generally comprise the metal in a stoichiometric amount or else in excess, therefore in an amount greater than the stoichiometric amount. These are then overbased detergent additives; the excess metal providing the overbased nature to the detergent additive is then generally in the form of an oil-insoluble metal salt, for example a carbonate, a hydroxide, an oxalate, an acetate, a glutamate, preferentially a carbonate.

Advantageously, the lubricating composition according to the invention may comprise from 2 to 4% by weight of a detergent additive based on the total mass of the lubricating composition.

Also advantageously, the lubricating composition according to the invention may also comprise at least one additive lowering the pour point.

By slowing down the formation of paraffin crystals, the additives lowering the pour point generally improve the cold behavior of the lubricating composition according to the invention.

As examples of additives lowering the pour point, mention may be made of alkyl polymethacrylates, polyacrylates, polyarylamides, polyalkylphenols, polyalkylnaphthalenes, alkylated polystyrenes.

Advantageously, the lubricating composition according to the invention may also comprises at least one dispersant agent.

The dispersant agent may be selected from Mannich bases, succinimides and derivatives thereof.

Also advantageously, the lubricating composition according to the invention may comprise from 0.2 to 10% by mass of dispersant agent based on the total mass of the lubricating composition.

Advantageously, the lubricating composition may also comprise at least one additional polymer improving the viscosity index. This additional polymer is generally different from the oil-soluble polymer selected from among polyalkylene-glycols (PAG).

As examples of an additional polymer improving the viscosity index, mention may be made of polymeric esters, homopolymers or copolymers, either hydrogenated or not hydrogenated, styrene, butadiene and isoprene, polymethacrylates (PMA).

Also advantageously, the lubricating composition according to the invention may comprise from 1 to 15% by mass based on the total mass of the lubricating composition of polymer soluble in oil selected from among polyalkylene-glycols (PAG) and of this additional polymer improving the viscosity index.

The lubricating composition according to the invention may appear in different forms. The lubricating composition according to the invention may notably be an anhydrous composition.

Preferably, this lubricating composition is not an emulsion.

The invention also relates to the use of the lubricating composition according to the invention for reducing fuel consumption of an engine, in particular a vehicle engine.

The invention also relates to the use of the lubricating composition according to the invention for reducing the traction coefficient of an oil for a vehicle engine.

The invention also relates to the use of the lubricating composition according to the invention for reducing the fuel consumption of a vehicle equipped with lubricated bridge or gear box by means of this composition.

The invention also relates to the use of the lubricating composition according to the invention for reducing the fuel consumption of a vehicle equipped with a lubricated transmission by means of this composition.

The invention also relates to the use of the lubricating composition according to the invention for reducing the traction coefficient of a transmission oil, in particular a gear box oil or a bridge oil.

The invention also relates to the use of at least one oil of formula (I) according to the invention for improving the Fuel Eco (FE) of a lubricant.

The invention also relates to the use of at least one oil of formula (I) according to the invention for reducing the fuel consumption of an engine, in particular a vehicle engine.

The invention also relates to the use of at least one oil of formula (I) according to the invention for reducing the traction coefficient of an oil for vehicle engine.

The invention also relates to the use of at least one oil of formula (I) according to the invention for reducing the fuel consumption of a vehicle equipped with a bridge or gear box by means of this oil.

The invention also relates to the use of at least one oil of formula (I) according to the invention for reducing the fuel consumption of a vehicle equipped with a lubricated transmission by means of this oil.

The invention also relates to the use of at least one oil of formula (I) according to the invention for reducing the traction coefficient of a transmission oil, in particular of an oil for a gear box or a bridge oil.

According to the invention, the oil of formula (I) and the lubricating composition may be used for lubricating a vehicle engine.

These uses of the lubricating composition according to the invention or of the oil of formula (I) comprises the putting of at least one element of the engine, of the transmission, in particular of the gear box or of the bridge, in contact with a lubricating composition according to the invention or else with an oil of formula (I).

By analogy, the particular, advantageous or preferred characteristics of the oil of formula (I) according to the invention or of the lubricating composition according to the invention define particular, advantageous or preferred uses according to the invention.

The invention also relates to a method for preparing the lubricating composition according to the invention from at least one oil of formula (I)

(I)

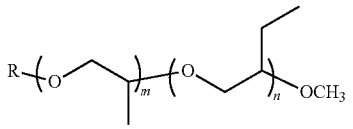

wherein

R represents a linear or branched $C_{11}$-$C_{30}$ alkyl group;

m and n represent independently an average number ranging from 1 to 5.

The oil of formula (I) is generally prepared from an initiator alcohol of formula R—OH mixed with a solution of an alkaline or earth-alkaline metal hydroxide.

As an initiator alcohol, 2-ethyl-hexanol and dodecanol are preferred. As an alkaline or earth-alkaline metal hydroxide, potassium hydroxide is preferred.

Under an inert atmosphere, a mixture of at least one initiator alcohol and of at least one earth-alkaline metal hydroxide is heated to a temperature which may range from 80 to 130° C., for example about 115° C.

Next, the water present in the medium is removed, for example by flash evaporation, in order to limit the presence of water, for example to a concentration of less than 0.1% by weight.

Next, the 1,2-propylene oxide and 1,2-butylene oxide are introduced, at a temperature which may range from 90 to 150° C., for example about 130 C, and at a pressure which may range from 350 to 550 kPa. The mixture is stirred and left to act for 5 to 25 hours.

Next, the residual catalyst is separated, for example by filtration through magnesium silicate.

An intermediate product of formula (II) is obtained (II)

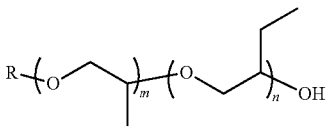

wherein

R represents a linear or branched $C_1$-$C_{30}$ alkyl group;

m and n represent independently an average number ranging from 1 to 5.

Next, the intermediate product of formula (II) is reacted in the presence of a solution of alkaline or earth-alkaline metal alkoxide solution in an alcohol, for example methanol, at a temperature which may range from 80 to 140° C., for example 120° C., and under reduced pressure, for example less than 1 kPa, and under an inert atmosphere. As an alkaline or earth-alkaline metal alkoxide, sodium methoxide is preferred.

An alkyl halide is added and left to act, under an inert atmosphere, at a temperature which may range from 50 to 130 C, for example 80 C, at a pressure which may range from 120 to 350 kPa, for example 260 kPa, and for 5 to 25 hours. As an alkyl halide, methyl chloride is preferred.

The mixture is stirred and left to act for 15 min to 15 hours, for example for 1.5 hours, and at a temperature which may range from 50 to 130 C, for example 80 C.

Next, the alkyl ether formed and the unreacted alkyl halide are separated, for example by flash evaporation. The alkaline or earth-alkaline metal halide is washed for example with water.

The saline aqueous phase is for example separated by decantation. Next, the residual water is separated, for example with magnesium silicate and flash evaporation. It is possible to let the mixture cool and then filter it, for example with magnesium silicate, in order to obtain an oil of formula (I) according to the invention.

The oil of formula (I) according to the invention may be incorporated with one or several other base oils and one or several additives in order to form the lubricating composition according to the invention.

The different aspects of the invention are illustrated by the following examples.

EXAMPLE 1: PREPARATION OF A PAG OIL OF FORMULA (I) ACCORDING TO THE INVENTION—OIL (1)

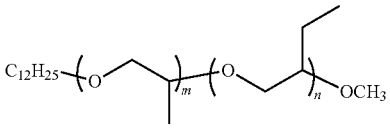

average values: m=3.53 and n=2.84

In an autoclave stainless steel reactor, dodecanol (2,647 g) is introduced as an initiator followed by a solution of 45% by mass of potassium hydroxide (28.2 g). The mixture is heated to 115° C. under a nitrogen atmosphere.

Next, the water is removed by flash evaporation (115° C., 3 MPa) up to a concentration of water of less than 0.1% by weight.

A mixture of 1,2-propylene oxide (2,910 g) and of 1,2-butylene oxide (2,910 g) are introduced into the reactor at a temperature of 130° C. and at a pressure of 490 kPa. The mixture is stirred and is left to react for 14 hours at 130° C.

The residual catalyst is separated by filtration through magnesium silicate at 50° C. in order to obtain the intermediate product (A) for which the kinematic viscosity measured at 40° C. according to the ASTM D445 standard is of 22.4 $mm^2 \cdot s^{-1}$, the kinematic viscosity measured at 100° C.

according to the ASTM 445 standard is 4.76 $mm^2 \cdot s^{-1}$, the viscosity index is 137 and the pour point is −48° C.

In an autoclave reactor in stainless steel, the product (A) (8,266 g) is introduced. A solution of sodium methoxide at 25% by mass in methanol (3,060 g) is added and is stirred (180 revolutions per minute), at 120° C. for 12 hours, at a reduced pressure (less than 1 kPa) with a nitrogen flow (200 mL per minute).

Methyl chloride (751 g) is added at 80° C. and under pressure (260 kPa).

The mixture is stirred and is left to react for 1.5 hours at 80° C.

Next, flash evaporation is carried out (10 mins, 80° C., under reduced pressure) for separating dimethyl ether and methyl chloride not having reacted.

Water (2,555 g) is added and then is stirred for 40 minutes at 80° C. for washing the sodium chloride from the mixture. Stirring is stopped and the mixture is left at rest for 1 hour at 80° C.

The saline aqueous phase is separated by decantation (3,283 g), magnesium silicate (50 g) is added to the remaining mixture and flash evaporation is carried out (1 hour, 100° C., at a pressure of less than 1 kPa) under a nitrogen flow (200 mL per minute) and with stirring (180 revolutions per minute) in order to separate the residual water.

The mixture is left to cool at 60° C. and then is filtered on magnesium silicate at 50° C. for separating the oil (1) (8,359 g). The yield of the methylation step is of 98.6% by mass.

For this oil (1), the kinematic viscosity measured at 40° C. according to the ASTM D445 standard is 14.4 $mm^2 \cdot s^{-1}$, the kinematic viscosity measured at 100° C. according to the ASTM D445 standard is 3.98 $mm^2 \cdot s^{-1}$ and the pour point measured according to the ISO 3016 standard is −54° C.

The viscosity index of this oil is 194 and its dynamic viscosity (CCS) at −35° C., measured according to the ASTM D5293 standard is 1,120 mPa·s.

EXAMPLE 2: PREPARATION OF A PAG OIL OF FORMULA (I) ACCORDING TO THE INVENTION—OIL (2)

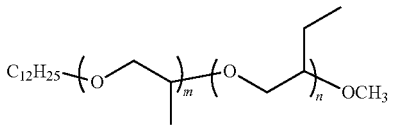

average values: m=2.45 and n=1.97

In an autoclave stainless reactor, dodecanol (2,369 g) is introduced as an initiator and then a solution of 45% by mass of potassium hydroxide (20.02 g). The mixture is heated to 115° C. under a nitrogen atmosphere. Flash evaporation is carried out (115° C. and 3 MPa) of the mixture for separating the water. The water concentration of the mixture is lowered to less than 0.1% by mass.

A mixture of 1,2-propylene oxide (1,808.5 g) and of 1,2-butylene oxide (1,808.5 g) are introduced into the reactor at a temperature of 130° C. and at a pressure of 490 kPa. The mixture is stirred and left to react for 14 hours at 130° C.

The residual catalyst is separated by filtration through magnesium silicate at 50° C. in order to obtain the intermediate product (B) for which the kinematic viscosity measured at 40° C. according to the ASTM D445 standard is 16.1 $mm^2 \cdot s^{-1}$, the kinematic viscosity measured at 100° C. according to the ASTM D445 standard is 3.7 $mm^2 \cdot s^{-1}$ and the pour point is −39° C.

In an autoclave stainless steel reactor, some product (B) (5,797 g) is introduced. A solution of sodium methoxide at 25% by mass in methanol (2,765 g) is added and is stirred (180 revolutions per minute), at 120° C. for 12 hours, at a reduced pressure (less than 1 kPa) with a nitrogen flow (200 mL per minute).

A portion of the mixture (3,825 g) of the reactor is emptied.

Next, in the other portion of the mixture (2,264 g) having remained in the reactor, methyl chloride (252 g) at 80° C. and under pressure (260 kPa) is added.

The mixture is stirred and is left to act for 1.5 hours at 80° C.

Next, flash evaporation is carried out (10 mins, 80° C., under reduced pressure) for separating dimethyl ether and the unreacted methyl chloride.

Water (796 g) is added and then stirred for 40 minutes at 80° C. for washing the sodium chloride of the mixture. The stirring is stopped and the mixture is left at rest for 1 hour at 80° C.

The saline aqueous phase (961 g) is separated by decantation, magnesium silicate (50 g) is added to the remaining mixture and flash evaporation is carried out (1 hour, 100° C., at a pressure of less than 1 kPa) under a flow of nitrogen (200 mL per minute) and with stirring (180 revolutions per minute).

The mixture is left to cool at 60° C. and then it is filtered on magnesium silicate at 50° C. for separating the oil (2) (2,218 g). The yield of the methylation step is 93.7% by mass.

For this oil (2), the kinematic viscosity measured at 40° C. according to the ASTM D445 standard is 9.827 $mm^2 \cdot s^{-1}$, the kinematic viscosity measured at 100° C. according to the ASTM D445 standard is 2.97 $mm^2 \cdot s^{-1}$ and the pour point measured according to the ISO 3016 standard is −48° C.

The viscosity index of this oil is 172 and its dynamic viscosity (CCS) at −35° C. measured according to the ASTM D5293 standard is 450 mPa·s.

COMPARATIVE EXAMPLE 3: PREPARATION OF A KNOWN PAG OIL—COMPARATIVE OIL (1)

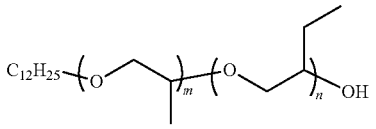

average values: m=1.76 and n=1.42

In an autoclave stainless steel reactor, dodecanol (4,364 g) is introduced as an initiator followed by a solution of 45% by mass of potassium hydroxide (39.68 g). The mixture is heated to 115° C. under a nitrogen atmosphere.

Flash evaporation is carried out (115° C. and 3 MPa) of the mixture for separating the water. The water concentration of the mixture is lowered to 0.1% by mass.

1,2-propylene oxide (2,276 g) and 1,2-butylene oxide (2,276 g) are introduced into the reactor at a temperature of 130° C. and at a pressure of 370 kPa. The mixture is stirred and left to act for 12 hours at 130° C.

The residual catalyst is separated by filtration through magnesium silicate at 50° C. in order to obtain the comparative oil (1) for which the kinematic viscosity measured at 40° C. according to the ASTM D445 standard is 12.2 $mm^2 \cdot s^{-1}$, the kinematic viscosity measured at 100° C. according to the ASTM D445 standard is 3.0 $mm^2 \cdot s^{-1}$ and the pour point is −29° C.

The viscosity index of this oil is 60 and its dynamic viscosity (CCS) at −35° C., measured according to the ASTM D5293 standard is 4,090 mPa·s.

COMPARATIVE EXAMPLE 4: PREPARATION OF A KNOWN PAG OIL—COMPARATIVE OIL (2)

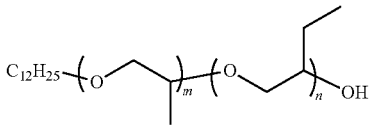

average values: m=2.79 and n=2.25

In an autoclave stainless steel reactor, dodecanol (3,141 g) is introduced as an initiator followed by a solution of 45% by mass of potassium hydroxide (38.4 g). The mixture is heated to 115° C. under a nitrogen atmosphere. Flash evaporation is carried out (115° C. and 3 MPa) of the mixture for separating the water. The water concentration of the mixture is lowered to 0.1% by mass.

A mixture of 1,2-propylene oxide (2,735.5 g) and of 1,2-butylene oxide (2,735.5 g) is introduced into the reactor at a temperature of 130° C. and at a pressure of 370 kPa. The mixture is stirred and left to react for 12 hours at 130° C.

The residual catalyst is separated by filtration through magnesium silicate at 50° C. in order to obtain the comparative oil (2) for which the kinematic viscosity measured at 40° C. according to the ASTM D445 standard is 18.0 $mm^2 \cdot s^{-1}$, the kinematic viscosity measured at 100° C. according to the ASTM D445 standard is 4.0 $mm^2 \cdot s^{-1}$ and the pour point is −41° C.

The viscosity index of this comparative oil (2) is 116 and its dynamic viscosity (CCS) at −35° C., measured according to the ASTM D5293 standard is 3,250 mPa·s.

EXAMPLE 5: PREPARATION OF LUBRICATING COMPOSITIONS ACCORDING TO THE INVENTION, OF COMPARATIVE LUBRICATING COMPOSITIONS AND EVALUATION OF THE PROPERTIES OF THESE COMPOSITIONS FOR THE LUBRICATION OF THE TRANSMISSION OF A MOTOR VEHICLE

The lubricating compositions are prepared by mixing the oil (2) according to Example 2 and oils known with other base oils and with additives for preparing lubricating compositions according to the amounts (% by mass) of table 1.

TABLE 1

| | Composition (1) according to the invention | Composition (2) according to the invention | Comparative composition (1) |
|---|---|---|---|
| base oil of group III (KV100/ASTM D445 = 3) | 20.0 | / | 40.75 |
| base oil of group III (KV100/ASTM D445 = 4) | 41.75 | 43.3 | 41.0 |

TABLE 1-continued

| | Composition (1) according to the invention | Composition (2) according to the invention | Comparative composition (1) |
|---|---|---|---|
| oil (2) according to the invention | 20.0 | 38.45 | / |
| additive improving the viscosity index (polymethacrylate - PMA) | 6.0 | 6.0 | 6.0 |
| additive improving viscosity (polyethylene-polypropylene - PEPP) | 5.0 | 5.0 | 5.0 |
| mixture of additives (dispersant, detergent, antioxidant, extreme pressure agent, anti-wear, anti-foam agent) | 7.0 | 7.0 | 7.0 |
| friction reducing additive (organo-molybdenum) | 0.2 | 0.2 | 0.2 |
| siliconed anti-foam additive | 0.05 | 0.05 | 0.05 |

The characteristics of the prepared lubricating compositions are evaluated and the obtained results are shown in table 2.

TABLE 2

| | Composition (1) according to the invention | Composition (2) according to the invention | Comparative composition (1) |
|---|---|---|---|
| viscosity index (ISO 2909) | 197 | 205 | 185 |
| traction coefficient (MTM: T = 40 C., $V_e$ = 1 m/s, SRR = 20% load = 75 N) | 0.045 | 0.043 | 0.053 |
| Energy yield deviation relatively to a commercial oil | 0.20 | 0.21 | 0.06 |
| resistance to oxidation (CEC 1517) (160 C.-192 h) | | | |
| KV 40 variation (%) | −5.0 | 8.6 | 21.01 |
| KV100 variation (%) | 5.4 | 4.3 | 18.95 |
| TAN variation (mg KOH/g) | 0.23 | 0.22 | 1.3 |
| amount of insoluble materials (% by mass) | 0.0012 | 0.0032 | 0.004 |
| Compatibility of elastomers (variation of hardness for | | | |
| RE1 fluorocarbon | 2 | 1 | 3 |
| RE2 polyacrylate ACM | 1 | −3 | −2 |
| HNBR1 | −1 | −3 | 1 |
| 75FKM595 | 8 | 9 | ND |
| 4 beads wear test (464 PSA D55-1078/RENAULT D55 1994) diameter of wear (mm) | 0.80 | 0.74 | 0.73 |
| 4 beads extreme pressure test (4B6 ASTM D551136) diameter of wear before jamming (mm) | 0.47 | 0.46 | ND |
| last load before jamming (kg) | 90 | 90 | ND |
| diameter of wear at the first jamming (mm) | 1.36 | 0.87 | ND |
| first systematic jamming load (kg) | 120 | 120 | ND |

ND: no-availability

The energy yield is evaluated by comparison with a commercial oil for a gear box based on oils of group III (KV100=7.46 $mm^2 \cdot s^{-1}$, KV40=33.97 $mm^2 \cdot s^{-1}$, VI=196). The energy yield deviation between the evaluated compositions and this commercial oil is measured.

This test therefore gives the possibility of evaluating the energy yield and of quantifying the yield of the gear box used by comparing the output torque with the input torque.

The Fuel Eco property of the oils for gear boxes applied may thereby be evaluated.

During this test, a manual gear box with five gears was used. The oil temperatures are 20° C. and 50° C. They give the possibility of well differentiating the oils with their Fuel Eco properties, in particular under cold conditions (20° C.). The input torque is set to 30 Nm and then to 90 Nm. The input conditions are set to 1,000 rpm and then to 3,000 rpm. For each oil temperature and for each gear ratio, the conditions of use are shown in table B.

TABLE B

| Temperature of the oil (° C.) | Gear ratio | Torque at the input (Nm) | Conditions at the input (rpm) |
|---|---|---|---|
| 20 | R2 | 30 | 1,000 |
| | | 90 | 3,000 |
| | | 30 | 1,000 |
| | | 90 | 3,000 |
| | R3 | 30 | 1,000 |
| | | 90 | 3,000 |
| | | 30 | 1,000 |
| | | 90 | 3,000 |
| 50 | R4 | 30 | 1,000 |
| | | 90 | 3,000 |
| | | 30 | 1,000 |
| | | 90 | 3,000 |
| | R5 | 30 | 1,000 |
| | | 90 | 3,000 |
| | | 30 | 1,000 |
| | | 90 | 3,000 |

This test gives the possibility of simulating an NEDC European test and of determining $CO_2$ emission and the fuel consumption of a gear box lubricated by means of a particular oil. The higher the yield value, better is the reduction in fuel consumption.

Thus, it is ascertained that as compared with a lubricating composition comprising two oils of group III of the state of the art, the lubricating compositions comprising the oil (2) according to the invention have improved properties.

The viscosity index is highly superior. The traction coefficient is lowered to at least 7%. The energy yield is also strongly improved and allows a gain of more than 3 times greater relatively to a composition based on a commercial oil based on oils of group III. These parameters therefore give the possibility of demonstrating the Fuel Eco gain of the composition according to the invention.

The lubricating compositions according to the invention also have a resistance to oxidation which is of the same level or even greater than that of the lubricating composition according to the state of the art. Their compatibility with the different elastomers may be used in transmission gaskets with which they are in contact, is also of the same level or even better than that of the lubricating composition of the state of the art.

Further, the compositions according to the invention allow good resistance to wear of the mechanical parts of a transmission for automobiles.

Finally it is ascertained that the improvements in the properties of the lubricating composition comprising 20% of oil (2) according to the invention are of the same order or even greater than those of the lubricating composition comprising 38.45% of oil (2) according to the invention.

EXAMPLE 6: PREPARATION OF LUBRICATING COMPOSITIONS ACCORDING TO THE INVENTION, OF COMPARATIVE LUBRICATING COMPOSITIONS AND EVALUATIONS OF THE PROPERTIES OF THESE COMPOSITIONS FOR THE LUBRICATION OF A VEHICLE ENGINE

The lubricating compositions are prepared by mixing oil (1) according to Example 1 and known oils with other base oils and with additives for preparing lubricating compositions according to the amounts (% by mass) of table 3.

TABLE 3

| | Composition (3) according to the invention | Composition (4) according to the invention | Comparative composition (2) |
|---|---|---|---|
| base oil of group III (KV100/ASTM D445 = 4.16 $mm^2 \cdot s^{-1}$) | 45.45 | 37.45 | 37.45 |
| base oil of group III: Neste Nexbase 3050 | 29.0 | 17.3 | 15.0 |
| base of group IV PAO (KV100/ASTM D445 = 4.08 $mm^2 \cdot s^{-1}$) | / | / | 30.0 |
| oil (1) according to the invention | 8.0 | 27.7 | / |
| mixture of additives (dispersants, detergent, DTPZn, amine antioxidant, phenolic antioxidant) | 10.9 | 10.9 | 10.9 |
| additive improving the viscosity index (hydrogenated polyisoprene-styrene - PISH) | 3.2 | 3.2 | 3.2 |
| additive improving the viscosity index (PMA) | 2.9 | 2.9 | 2.9 |
| friction reducing additive (MoDTC) | 0.5 | 0.5 | 0.5 |
| anti-corrosion additive of the amine type | 0.05 | 0.05 | 0.05 |

The characteristics of the prepared lubricating compositions are evaluated and the obtained results are shown in table 4.

TABLE 4

| | Composition (3) according to the invention | Composition (4) according to the invention | Comparative composition (2) |
|---|---|---|---|
| viscosity index (ISO 2909) | 192 | 202 | 190 |
| Noack volatility (CEC L-40-93) (%) | 10.3 | 9.5 | 10.4 |
| dynamic viscosity (CCS) at −35° C. (ASTM D5293) (mPa · s) | 6,790 | 4,970 | 4,970 |
| resistance to oxidation (method GFC Lu-36-T-03) (170 C.-144 h) | | | |
| KV100 variation after 144 h (ISO 3,405) (%) | −13.7 | −10.6 | −6.74 |
| TAN variation after 144 h (ASTM D664) (mg KOH/g) | 3.1 | 4.8 | 7.1 |
| PAI variation after 144 h (ASTM D7214) ($A \cdot cm^{-1} \cdot mm^{-1}$) | 55 | 173 | 102 |

TABLE 4-continued

| | Composition (3) according to the invention | Composition (4) according to the invention | Comparative composition (2) |
|---|---|---|---|
| detergency - global score 1 (average) (CEC M-02-A-78) (merit/10) | 6.0 | 5.4 | 5.5 |
| compatibility of elastomers hardness variation for | | | |
| RE1 fluorocarbon | ND | 0 | 0 |
| RE2 polyacrylate ACM | ND | 1 | 4 |
| RE3 silastic MCQ | ND | −22 | −21 |
| RE4 nitrile HNBR | ND | 0 | 1 |

ND: not available

As compared with a lubricating composition comprising two oils of group III and an oil of group IV of the state of the art, the lubricating compositions comprising the oil (1) according to the invention have improved properties.

The viscosity index is superior, or even highly superior, and the Noack volatility is improved. These parameters therefore give the possibility of demonstrating the «Fuel-Eco» gain of the composition according to the invention.

The lubricating compositions according to the invention also have a resistance to oxidation which is greater than that of the lubricating composition of the state of the art. The detergency of the lubricating compositions according to the invention is at the same level or even better than that of the lubricating composition of the state of the art.

The compatibility of the lubricating compositions according to the invention with the different elastomers may be used in the transmission gaskets with which they are in contact, is also on the same level or even better than that of the lubricating composition of the state of the art.

Finally it is ascertained that the improvements in the properties of the lubricating composition comprising 8% of oil (1) according to the invention are of the same order or even superior to those of the lubricating composition comprising 27.7% of oil (1) according to the invention.

EXAMPLE 7: PREPARATION OF A LUBRICATING COMPOSITIONS ACCORDING TO THE INVENTION, OF A COMPARATIVE LUBRICATING COMPOSITION AND EVALUATION OF THE PROPERTIES OF THESE COMPOSITIONS FOR THE LUBRICATION OF A VEHICLE ENGINE

The lubricating compositions are prepared by mixing the oil (1) according to Example 1 and known oils with other base oils according to the amounts (% by mass) of table 5. A comparative lubricating composition (3) is also prepared from a comparative oil (2) according to the comparative example (3).

TABLE 5

| | Composition (5) according to the invention | Comparative composition (3) |
|---|---|---|
| base oil group III (KV100/ASTM D445 = 4.16 $mm^2 \cdot s^{-1}$) | 37.45 | 37.45 |
| base oil group III: Neste Nexbase 3050 | 17.3 | 17.3 |

TABLE 5-continued

| | Composition (5) according to the invention | Comparative composition (3) |
|---|---|---|
| oil (1) according to the invention | 27.7 | / |
| Comparative oil (2) | / | 27.7 |
| mixture of additives (dispersants, detergent, DTPZn, amine antioxidant, phenolic antioxidant) | 10.9 | 10.9 |
| additive improving the viscosity index (PISH) | 3.2 | 3.2 |
| additive improving the viscosity index (PMA) | 2.9 | 2.9 |
| friction reducing additive (MoDTC) | 0.5 | 0.5 |
| anti-corrosion additive of the amine type | 0.05 | 0.05 |

The characteristics of the prepared lubricating compositions are evaluated and the obtained results are shown in table 6.

TABLE 6

| | Composition (5) according to the invention | Comparative composition (3) |
|---|---|---|
| kinematic viscosity measured at 100 C. (ASTM D445) ($mm^2 \cdot s^{-1}$) | 9.672 | 9.858 |
| viscosity index (ISO 2909) | 202 | 193 |
| Noack volatility (CEC L-40-93) (%) | 9.5 | 12.3 |
| dynamic viscosity (CCS) at −35° C. (ASTM D5293) (mPa · s) | 4,970 | 6,250 |

As compared with a lubricating composition comprising two oils of group III and the comparative oil (2) of the state of the art, the lubricating composition comprising the oil (1) according to the invention has improved properties.

The kinematic viscosity measured at 100° C. is lower. The dynamic viscosity (CCS at −35° C.) is lower, which puts forward an improvement in the cold behavior of the composition according to the invention.

Further, the viscosity index is highly superior and the Noack volatility is strongly improved. These parameters therefore give the possibility of demonstrating the «Fuel-Eco» gain of the composition according to the invention.

EXAMPLE 8: PREPARATION OF A LUBRICATING COMPOSITION ACCORDING TO THE INVENTION, OF A COMPARATIVE LUBRICATING COMPOSITION AND EVALUATION OF THE PROPERTIES OF THESE COMPOSITIONS FOR THE LUBRICATION OF A VEHICLE ENGINE

The lubricating compositions are prepared by mixing the oil (1) according to Example 1 and known oils with other base oils and with additives for preparing lubricating compositions according to the amounts (% by mass) of table 7.

TABLE 7

| | Composition (6) according to the invention | Comparative composition (4) |
|---|---|---|
| base oil of group III (KV100/ASTM D445 = 4.38 $mm^2 \cdot s^{-1}$) | 48.7 | 48.7 |

TABLE 7-continued

| | Composition (6) according to the invention | Comparative composition (4) |
|---|---|---|
| base oil of group IV PAO (KV100/ASTM D445 = 4.08 $mm^2 \cdot s^{-1}$) | 20.0 | 20.0 |
| oil (1) according to the invention | 10.0 | / |
| Comparative oil (2) | / | 10.0 |
| mixture of additives (dispersants, detergent, DTPZn, amine antioxidant, phenolic antioxidant) | 12.6 | 12.6 |
| friction modifier additive (glycerol monooleate) | 0.5 | 0.5 |
| additive improving the pour point (PMA) | 0.2 | 0.2 |
| additive improving the viscosity index (PISH) | 8.0 | 8.0 |

The characteristics of the prepared lubricating compositions are evaluated and the obtained results are shown in table 8.

TABLE 8

| | Composition (6) according to the invention | Comparative composition (4) |
|---|---|---|
| viscosity index (ISO 2909) | 195 | 192 |
| kinematic viscosity measured at 100 C. (ISO 31404) ($mm^2 \cdot s^{-1}$) | 8.115 | 8.043 |
| dynamic viscosity (CCS) at −35° C. (ASTM D5293) (mPa · s) | 4,480 | 4,950 |
| basicity number (total base number: TBN) (ASTM D2896) | 7.3 | 7.8 |
| resistance to oxidation (Daimler oxidation test FO - DIN 51453) (100 C.-168 h) (%) | −9.1 | −13.3 |
| resistance to oxidation (Daimler oxidation test 5% B100 - DIN 51453) (100 C.-168 h) (%) | 18.8 | 14.2 |
| Fuel Eco (W24 C250 CDI/engine - OM651 vs MB RL002) (%) | 3.84 | 2.62 |

As compared with a lubricating composition comprising an oil of group III, an oil of group IV and the comparative oil (2) of the state of the art, the lubricating composition comprising the oil (1) according to the invention has improved properties, and more particularly in "Fuel-Eco" gain.

The viscosity index is superior. The dynamic viscosity (CCS at −35° C.) is inferior.

The resistance to oxidation is improved.

EXAMPLE 9: PREPARATION OF A LUBRICATING COMPOSITION ACCORDING TO THE INVENTION, OF A COMPARATIVE LUBRICATING COMPOSITION AND EVALUATION OF THE PROPERTIES OF THESE COMPOSITIONS FOR THE LUBRICATION OF THE TRANSMISSION OF A MOTOR VEHICLE

The lubricating compositions are prepared by mixing the oil (2) according to Example 2 and known oils with other base oils and with additives for preparing lubricating compositions according to the amounts (% by mass) of table 9.

TABLE 9

| | Composition (7) according to the invention | Comparative composition (5) |
|---|---|---|
| base oil of group IV mPAO (KV100/ASTM D445 = 3.5 $mm^2 \cdot s^{-1}$) | 55 | 55 |
| oil (2) according to the invention | 16.3 | / |
| comparative oil (1) | / | 16.3 |
| additive improving the viscosity index (PMA) | 6.0 | 6.0 |
| additive improving the viscosity index (PMA) | 14.0 | 14.0 |
| Mixture of additives (dispersants, detergent, antioxidant, extreme pressure agent, anti-wear agent, anti-foam agent, DTPZn) | 8.7 | 8.7 |

The characteristics of the prepared lubricating compositions are evaluated and the obtained results are shown in table 10.

TABLE 10

| | Composition (7) according to the invention | Comparative composition (5) |
|---|---|---|
| viscosity index (ISO 2909) | 212 | 200 |
| traction coefficient (MTM: T = 40° C., $V_e$ = 1 m/s, SRR = 20% charge = 75 N) | 0.036 | 0.041 |

As compared with a lubricating composition comprising an oil of group IV and the comparative oil (1) of the state of the art, the lubricating composition comprising the oil (2) according to the invention has improved properties.

The viscosity index is much superior and the traction coefficient is lowered by more than 12%. These parameters therefore give the possibility of demonstrating the «Fuel-Eco» gain of the composition according to the invention.

The invention claimed is:

1. A lubricating composition comprising at least one oil of formula (I)

(I)

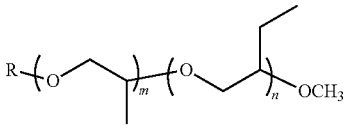

wherein

R represents a linear or branched $C_1$-$C_{30}$ alkyl group;

m and n represent independently an average number ranging from 1 to 5.

2. The lubricating composition according to claim 1 wherein R represents a group selected from the group consisting of a linear $C_8$ alkyl group; a branched $C_8$ alkyl group; a linear $C_9$ alkyl group; a branched $C_9$ alkyl group; a linear $C_{10}$ alkyl group; a branched $C_{10}$ alkyl group; a linear $C_{11}$ alkyl group; a branched $C_{11}$ alkyl group; a linear $C_{12}$ alkyl group; a branched $C_{12}$ alkyl group; a linear $C_{13}$ alkyl group; a branched $C_{13}$ alkyl group; a linear $C_{14}$ alkyl group; a branched $C_{14}$ alkyl group; a linear $C_{15}$ alkyl group; and a branched $C_{15}$ alkyl group.

3. The lubricating composition according to claim 1 wherein:

m is greater than or equal to n; or m represents an average number ranging from 2 to 4.5; or n represents an average number ranging from 1.5 to 4.

4. The lubricating composition according to claim 1 wherein:

m represents an average number ranging from 2.5 to 3.5; or n represents an average number ranging from 2 to 3.

5. The lubricating composition according to claim 1 wherein:

m represents an average number equal to 2.5 and n represents an average number equal to 2; or m represents an average number equal to 3.5 and n represents an average number equal to 2.8.

6. The lubricating composition according to claim 1 comprising at least one oil of formula (I) wherein:

(a) the kinematic viscosity at 100° C., measured according to the ASTM D445 standard, ranges from 2.5 to 4.5 $mm^2 \cdot s^{-1}$; or for which (b) the viscosity index is greater than 160 or is comprised between 160 and 210; or for which (c) the pour point is less than −40° C.; or for which (d) the dynamic viscosity (CCS) at −35° C., measured according to the ASTM D5293 standard is less than 1,200 mPa·s.

7. The lubricating composition according to claim 1, comprising at least one oil of formula (I) wherein:

(a) the kinematic viscosity at 100° C., measured according to the ASTM D445 standard, ranges from 2.5 to 4.5 $mm^2 \cdot s^{-1}$;

(b) the viscosity index is greater than 160 or is comprised between 160 and 210;

(c) the pour point is less than −40° C.; and (d) the dynamic viscosity (CCS) at −35° C., measured according to the ASTM D5293 standard is less than 1,200 mPa·s.

8. The lubricating composition according to claim 1, comprising at least one oil of formula (I) wherein m represents an average number equal to 2.5 and n represents an average number equal to 2 and wherein:

(a) the kinematic viscosity at 100° C., measured according to the ASTM D445 standard, ranges from 2.5 to 3.5 $mm^2 \cdot s^{-1}$;

(b) the viscosity index is comprised between 160 and 180;

(c) the pour point is less than −40° C.; and (d) the dynamic viscosity (CCS) at −35° C., measured according to the ASTM D5293 standard is less than 500 mPa·s.

9. The lubricating composition according to claim 1, comprising at least one oil of formula (I) wherein m represents an average number equal to 3.5 and n represents an average number equal to 2.8 and wherein:

(a) the kinematic viscosity at 100° C., measured according to the ASTM D445 standard, ranges from 3.5 to 4.5 $mm^2 \cdot s^{-1}$;

(b) the viscosity index is comprised between 180 and 210;

(c) the pour point is less than −50° C.; and (d) the dynamic viscosity (CCS) at −35° C., measured according to the ASTM D5293 standard is less than 1,200 mPa·s.

10. The lubricating composition according to claim 1, comprising from 2 to 60% by weight of at least one oil of formula (I).

11. The lubricating composition according to claim 8, comprising from 5 to 40% by weight of at least one oil of formula (I).

12. The lubricating composition according to claim 9, comprising from 5 to 35% by weight of at least one oil of formula (I).

13. The lubricating composition according to claim 1, further comprising:

at least one other base oil selected from the group consisting of oils of group III, oils of group IV and oils of group V; or at least one additive; or at least one other base oil selected from the group consisting of oils of the group III, oils of group IV and oils of group V and at least one additive.

14. A method for reducing the traction coefficient of a transmission oil, comprising providing and applying at least one lubricating composition according to claim 1.

15. A method for reducing the fuel consumption of an engine, or for reducing the fuel consumption of a vehicle equipped with a transmission, comprising providing and applying a suitable amount of at least one lubricating composition according to claim 1.

* * * * *